US009809969B2

(12) United States Patent
Kent

(10) Patent No.: US 9,809,969 B2
(45) Date of Patent: Nov. 7, 2017

(54) PARTITIONED SEPARATOR WATER TREATMENT SYSTEM WITH UPFLOW FILTER

(71) Applicant: BIOCLEAN ENVIRONMENTAL SERVICES, INC., Oceanside, CA (US)

(72) Inventor: Zaccharia Kent, Oceanside, CA (US)

(73) Assignee: Bio Clean Environmental Services, Inc., Oceanside, CA (US)

( * ) Notice: Subject to any disclaimer, the term of this patent is extended or adjusted under 35 U.S.C. 154(b) by 0 days.

(21) Appl. No.: 14/537,756

(22) Filed: Nov. 10, 2014

(65) Prior Publication Data

US 2015/0129473 A1 May 14, 2015

Related U.S. Application Data

(60) Provisional application No. 61/902,614, filed on Nov. 11, 2013.

(51) Int. Cl.
*B01D 33/00* (2006.01)
*B01D 27/02* (2006.01)
(Continued)

(52) U.S. Cl.
CPC ..... *E03F 5/14* (2013.01); *E03F 1/001* (2013.01)

(58) Field of Classification Search
CPC ..... B01D 27/02; B01D 29/15; B01D 29/52; B01D 29/62; B01D 29/66; B01D 29/68; B01D 29/72; B01D 33/00; B01D 35/30; B01D 2221/12; E03F 1/00; E03F 5/14; E03F 1/001
USPC ..... 52/4, 12, 14–16, 19–21; 137/247.33, 137/550; 210/108, 122, 123, 133, 154, 210/155, 156, 162, 163, 64, 170.03, 210/242.1, 242.2, 242.4, 256, 265, 282,
(Continued)

(56) References Cited

U.S. PATENT DOCUMENTS 6,428,690 B1 * 8/2002 Tse ..... B01D 24/167 210/136
8,002,984 B1 * 8/2011 Wanielista ..... B01J 20/043 210/602

(Continued)

FOREIGN PATENT DOCUMENTS

EP 0819457 * 1/1998 ..... B01D 24/26

OTHER PUBLICATIONS

Title: NPL-1 (Contech Stormwater Solutions) Date: Feb. 2006 Publsiher:Contech stormwater solutions.*

(Continued)

*Primary Examiner* — Dirk Bass
*Assistant Examiner* — Hayden Brewster
(74) *Attorney, Agent, or Firm* — Steven W. Webb

(57) ABSTRACT

A system designed to control and filter runoff water in storm drains is presented. Drain water frequently carries trash, organic matter, suspended solids, hydrocarbons, metals, nutrients and bacteria collected from streets and parking lots into a storm drain inlet, which enters storm water drain pipe systems.

The present invention supplies a series of baffle boxes inserted in the drain water stream with a final box possessing an upflow filter comprising filtration media and filter cartridges. The system can also support a storm flow bypass that directs high-flow storm runoff water directly to the outlet to protect the filter system.

14 Claims, 14 Drawing Sheets

(51) Int. Cl.

| | |
|---|---|
| ***E03F 5/14*** | (2006.01) |
| *E02B 15/00* | (2006.01) |
| *C02F 1/00* | (2006.01) |
| *E03F 1/00* | (2006.01) |

(58) Field of Classification Search
USPC .... 210/299, 304, 305, 306, 307, 310, 323.1, 210/323.2, 332, 333.01, 340, 391, 393, 210/435, 451, 455, 457, 490, 512.1, 521, 210/522, 532.1, 538, 540, 744, 747.2, 210/767, 785, 791, 793, 808, 924
See application file for complete search history.

(56) References Cited

U.S. PATENT DOCUMENTS

| | | | | |
|---|---|---|---|---|
| 8,123,935 | B2 * | 2/2012 | Murray | B01D 29/114 210/108 |
| 2005/0218049 | A1 * | 10/2005 | Happel | E03F 5/0404 210/163 |
| 2010/0032363 | A1 * | 2/2010 | Happel | B01D 21/0003 210/242.1 |
| 2011/0192773 | A1 * | 8/2011 | Kent | E03F 3/02 210/123 |

OTHER PUBLICATIONS

Title: Machine translation of EP0819457 Date: Jan. 1998 publisher:Espacenet.*

* cited by examiner

PARTITIONED SEPARATOR WATER TREATMENT SYSTEM WITH UPFLOW FILTER

This application claims priority to U.S. Provisional Patent Application 61/902,614, filed Nov. 11, 2014, the disclosure of which is hereby incorporated by reference in its entirety.

FIELD OF THE INVENTION

This invention relates to the fields of water filtration systems and storm water control systems.

BACKGROUND OF THE INVENTION

The present invention is designed to control and filter runoff water in storm drains. Drain water frequently carries trash, organic matter, suspended solids, hydrocarbons, metals, nutrients and bacteria collected from paved surfaces and other areas into a storm drain inlet, then sent into a storm water drain pipe system. Drain water often carries oil collected from the streets.

Various water bodies including ponds, rivers, and oceans can tolerate a certain amount of pollutant loading, but the amount allowed to flow into these collection areas should be minimized. The present invention is an in-line storm water drain filter system having a series of separation chambers for removing larger material followed by an upflow filter for smaller and dissolved material. The filter box is installed within a storm water drain pipe; this pipe directs drain water through the separation chambers and upflow filter to the storm water drain passing through an outfall into a lake, pond or retention area. There is an upflow filter between the separation chambers and the outflow to address collection of fine particulates and organics. A hydrocarbon collecting boom in a cage is placed at the last separation baffle on the influent side to absorb hydrocarbons.

SUMMARY OF THE INVENTION

The inline partitioned separator and upflow filter system is installed inline with the drain water flow path, and can be buried underground with access ports. The filter system includes a housing having an inlet and an outlet and a plurality of separation chambers formed therein. The separation chambers collect various densities of sediment for later cleaning. A housing cover allows access into the housing and a plurality of separation chambers and media cages.

An oil collection boom is removably mounted on one or more of the baffles near the outlet for collecting hydrocarbons in the drain water entering the system.

The separation chambers closest to the outflow are each equipped with an upflow filter. The upflow filter has two main components: the filter housing and the filtration media. The filter housing is constructed of a cage that holds the media. It has top doors that open to allow the media to be changed out.

The media is a filter that removes fine TSS, nutrients, metals, bacteria, and emulsified hydrocarbons from the drain water as it flows upward through the last separation chamber.

One of the unique features of this system is that fall between the inflow and outflow pipes is not necessary as with downward flow systems. The internal weir, located on the side of the upflow filter opposite of the outflow pipe allows water pressure to build behind it which drives water through the upflow filter.

A standard 2 chambered separator works well enough to provide the necessary drain water pretreatment to prevent larger particles and solid pollutants from prematurely clogging the upflow filter.

BRIEF DESCRIPTION OF THE FIGURES

FIG. 2B. Top view of an embodiment of a bottom panel of a media filtration unit of the invention.

DETAILED DESCRIPTION OF THE INVENTION

Figure 1:
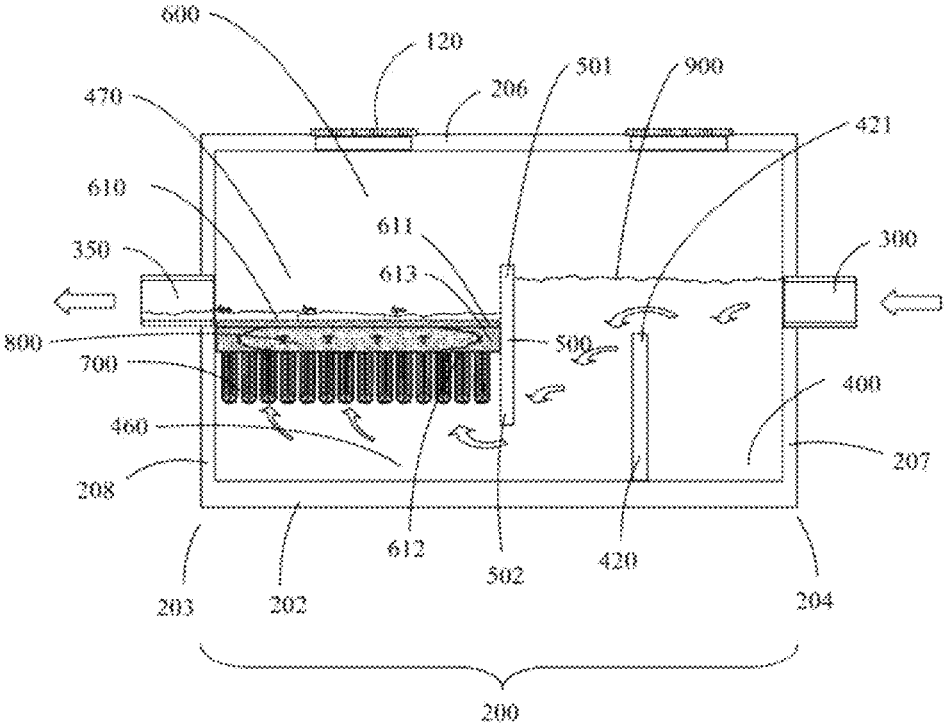
FIG. 1. Cut-out, side view of an embodiment of the invention in low flow configuration.

Referring to FIG. 1, a cut-out, side view of an embodiment of a partitioned separator water treatment system with an upflow filter assembly is shown. The system comprises rectangular box 200 having inflow end 204 that comprises inflow opening 300 in inflow end wall 207 and outflow end 203 that comprises outflow opening 350 in outflow end wall 208. Inflow opening 300 is configured to receive water from stormwater conveyance system infrastructure, such as pipes or channels. Box 200 comprises primary separation chamber 400 and secondary separation chamber 460, established by separation chamber weir 420. Separation chamber weir 420 is in sealed connection with floor 202 and lateral walls (not shown) of box 200, but not the ceiling 206 of box 200. The top 421 of primary separation chamber 400 or the top of weir 420 is positioned below the bottom of intake opening 300. This configuration results in water entering inflow opening 300, filling primary separation chamber 400, and flowing over the top 421 of primary separation chamber 400 or the top of weir 420 into secondary separation chamber 460. In the process, sufficiently dense and heavy waterborne sediment and debris is deposited in primary separation chamber 400 for later removal. Box 200 possesses openings in its ceiling 206 and removable covers 120.

The system further possesses a bypass weir and an upflow filter assembly. The upflow filter assembly comprises a media filtration unit 610, designed to hold granular media 800 and process water by passing through the media 800 in an upward path. and filter cartridges 700 designed by forming a pleated paper filter membrane 702 around the orifice 705, which is a hollow center located in the center of the filter cartridge 700 and provides an exit point out of the filter cartridge 700. The filter cartridge 700 processes water by passing through the pleated paper filter membrane 702 horizontally from all sides. Media filtration unit 610 is in sealed connection with outflow end wall 208, lateral walls (not shown) of box 200, and bypass weir 500. Bypass weir 500 is in sealed connection with lateral walls (not shown) of box 200, but not the floor 202 or the ceiling 206 of box 200. Media filtration unit 610 is configured to support filter cartridges 700 in a manner that permits water to flow from secondary separation chamber 460 into outflow chamber 470 only by passing through filter cartridges 700 and then media filtration unit 610 via the connection between the filter cartridge orifice 705, coupler 708, and the inline orifices 614 located on the bottom panel 612 of the media filtration unit 610.

Figure 2A:
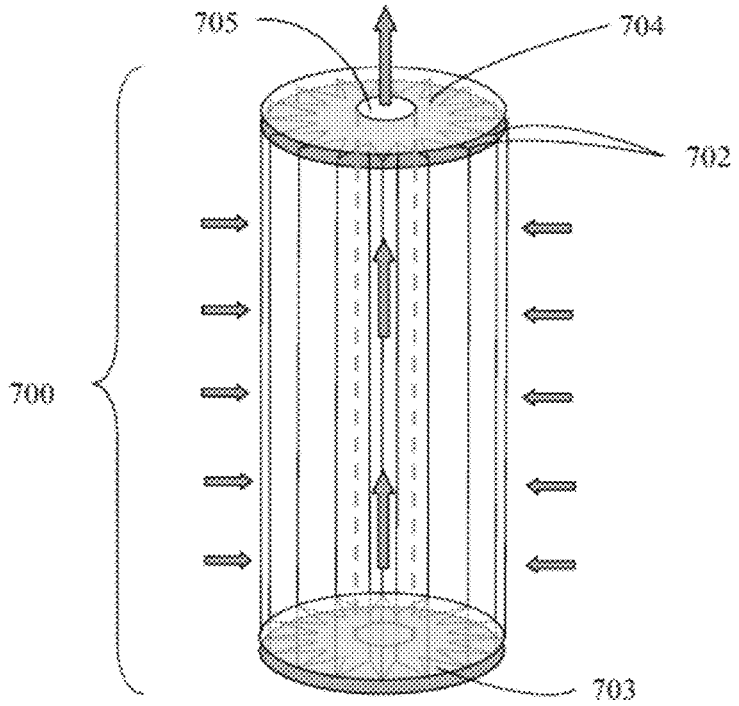
FIG. 2A. Side view of an embodiment of a filter cartridge of the invention.
Figure 28:
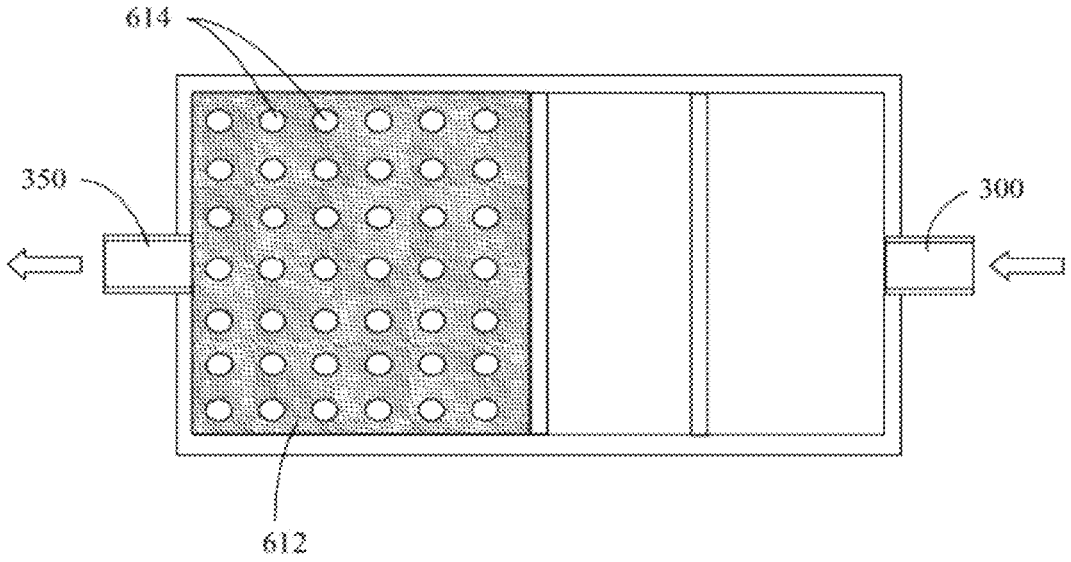
Figure 10:
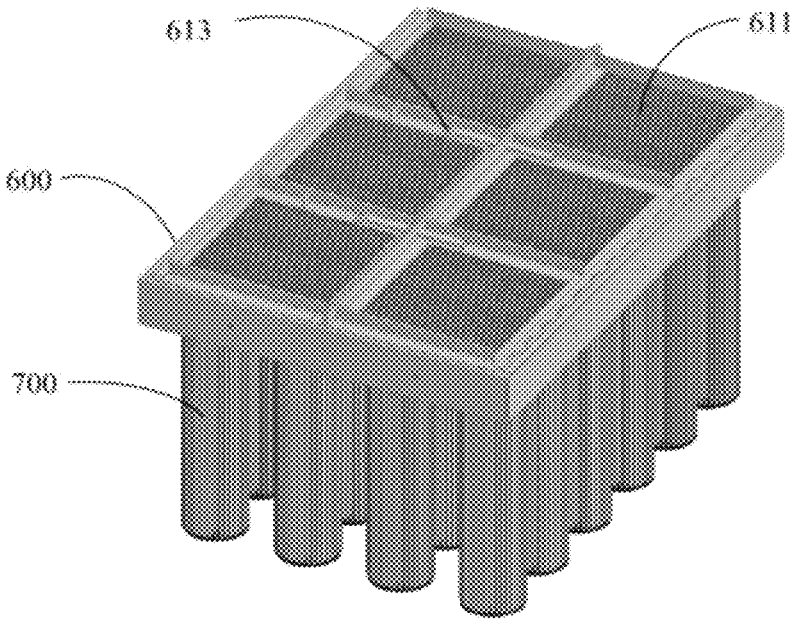
FIG. 10. Offset, iso view of an embodiment of an upflow filter assembly.

Filter cartridges 700 each comprise a sheet of filter material, such as porous plastic, paper, or fiberglass, folded back into a series of pleats 702 formed into a hollow cylinder, the ends of the cylinder closed by bottom end 703 that is water impermeable and top end 704 that is only permeable to water through an orifice opening 705 (FIGS 1 and 2A). Bottom end 703 and top end 704 are made from strong, durable material such as metal, plastic, or fiberglass. Filter cartridges 700 are operative to remove, from water flowing therethrough, waterborne particulate matter such as large and fine sediments and debris. Media filtration unit 610 comprises top panel 611 made of strong, durable material(s) such as metal or plastic in a water permeable configuration capable of inhibiting the passage of filtration media 800 therethrough, such as grate or screen configurations (FIG. 10). Referring again to FIG. 1, top panel 611 is sealingly fitted to solid side walls 613 (the central region of which is not illustrated to show filtration media 800) of media filtration unit 610. Media filtration unit 610 comprises bottom panel 612 made of strong, durable materials such as metal or plastic. Bottom panel 612 comprises a water impermeable configuration other than inline orifices 614 (shown from a top view perspective in FIG. 2B) allowing for each of the filter cartridges 700. Media filtration unit 610 is loaded with inorganic filtration media 800 such as zeolite, expanded aggregates, lava rock, oxide-coated inert material, alumina, activated carbon, perlite, stonewool, rockwool, and pumice. Media filtration unit 610 is operative to remove, from water flowing therethrough, waterborne particulate matter such as fine sediments and particulates and dissolved pollutants.

Figure 3:
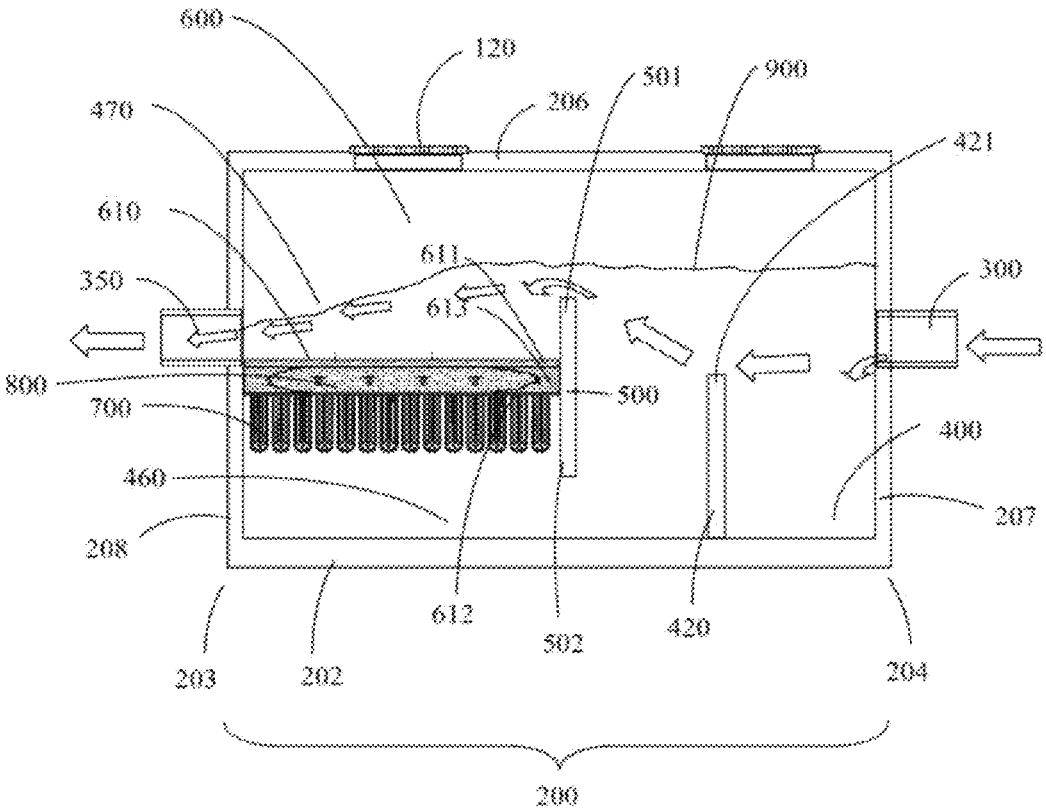
FIG. 3. Cut-out, side view an embodiment of the invention in high flow configuration.

In the process of performing its filtration functions, the upflow filter assembly impedes the flow of water from secondary separation chamber 460 into outflow chamber 470. This impedance makes possible conditions in which water enters inflow opening 300 at a rate greater than it flows from secondary separation chamber 460 into outflow chamber 470. Under such conditions, the water level 900 can rise in the portion of box 200 frontward of bypass weir 500 to the point where water flows over the top 501 of bypass weir 500, into outflow chamber 470, and out outflow opening 350, as shown in FIG. 3.

Figure 4:
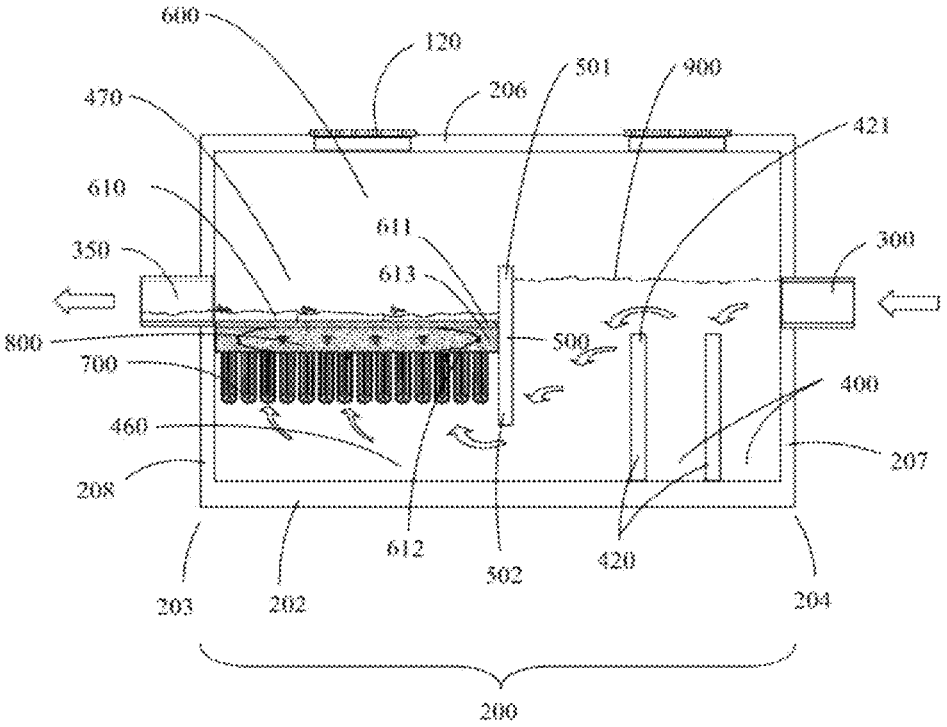
FIG. 4. Cut-out, side view of an embodiment of the invention in low flow configuration.

FIG. 4 shows a cut-out, side view of an embodiment of a partitioned separator water treatment system with an upflow filter assembly that differs from the embodiment illustrated in FIG. 1 by comprising a second separation chamber weir 420 and a second primary separation chamber 400.

Figure 5:
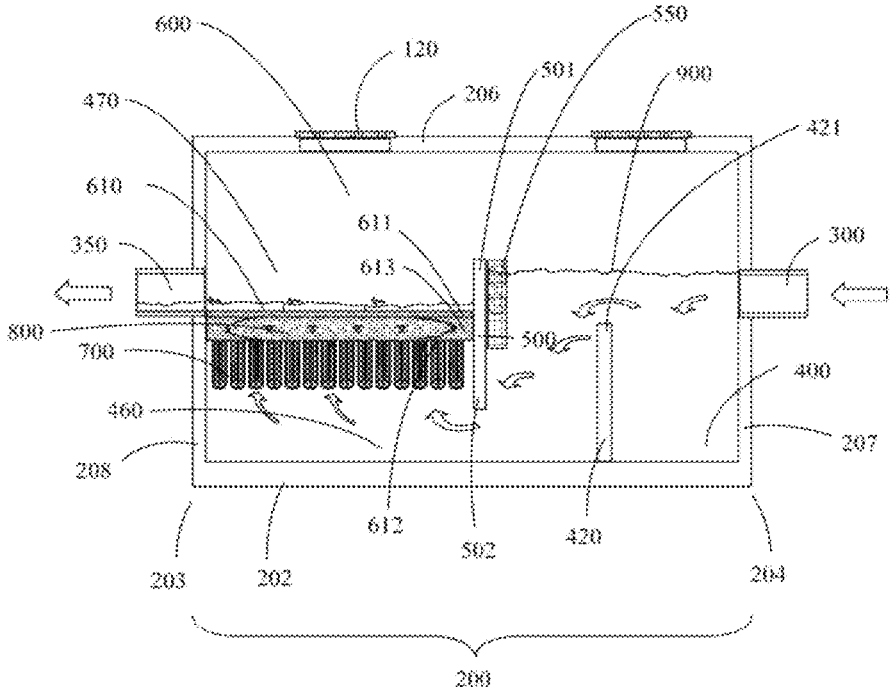
FIG. 5. Cut-out, side view of an embodiment of the invention in low flow configuration.

FIG. 5 shows a cut-out, side view of an embodiment of a partitioned separator water treatment system with an upflow filter assembly that differs from the embodiment illustrated in FIG. 1 by comprising a hydrocarbon filtration unit 550 mounted on bypass weir 500.

Figure 6:
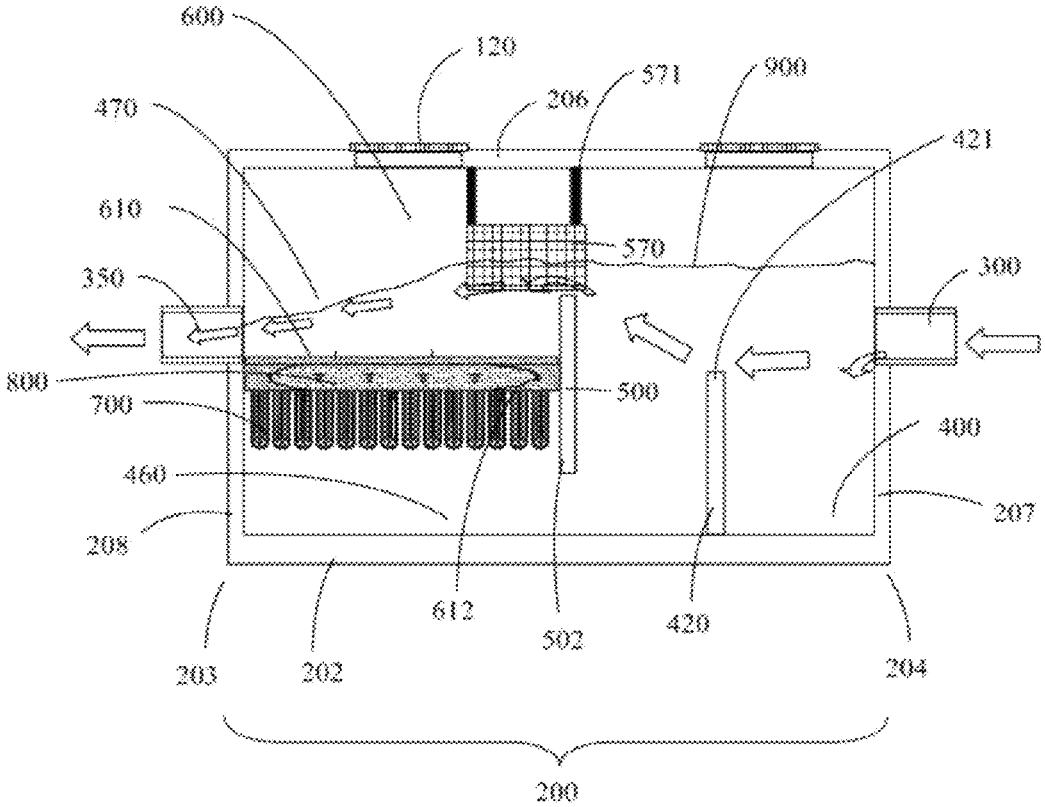
FIG. 6. Cut-out, side view of an embodiment of the invention in high flow configuration.

FIG 6 shows a cut-out, side view of an embodiment of a partitioned separator water treatment system with an upflow filter assembly that differs from the embodiment illustrated in FIG. 1 by comprising a bypass filtration basket 570 suspended in proximity with bypass weir 500 by posts 571 extending from ceiling 206 of box 200.

Figure 7A:
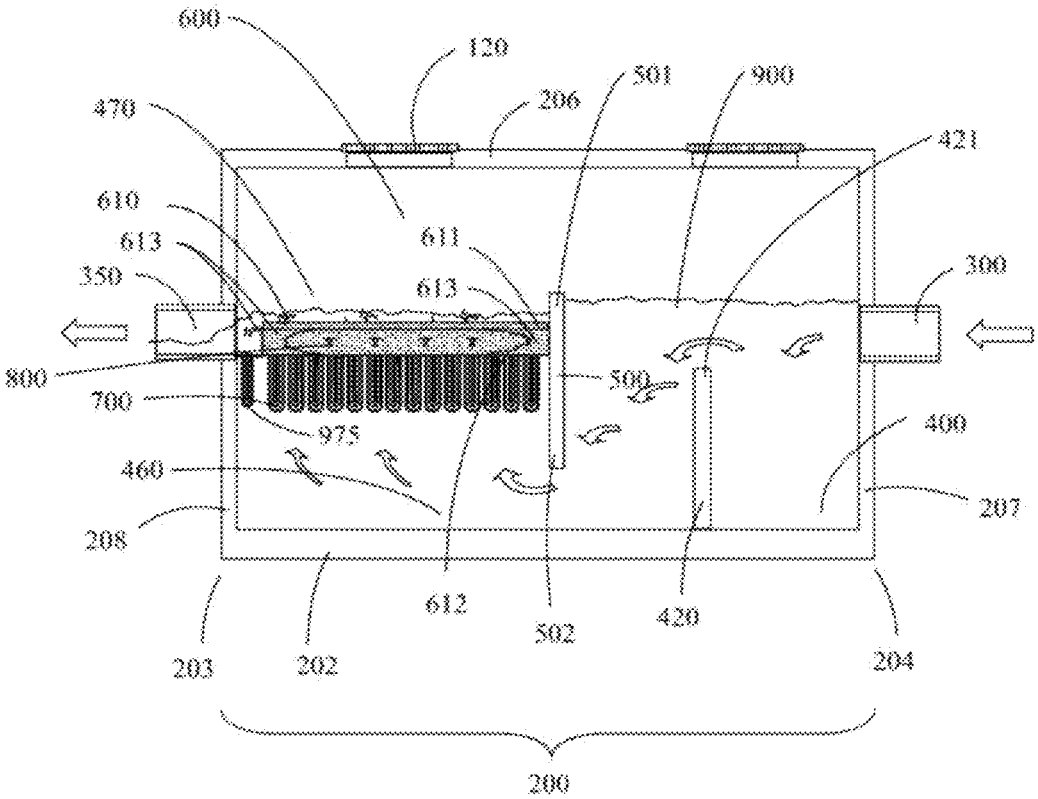
FIG. 7A. Cut-out, side view of an embodiment of the invention in low flow configuration.
Figure 7B:
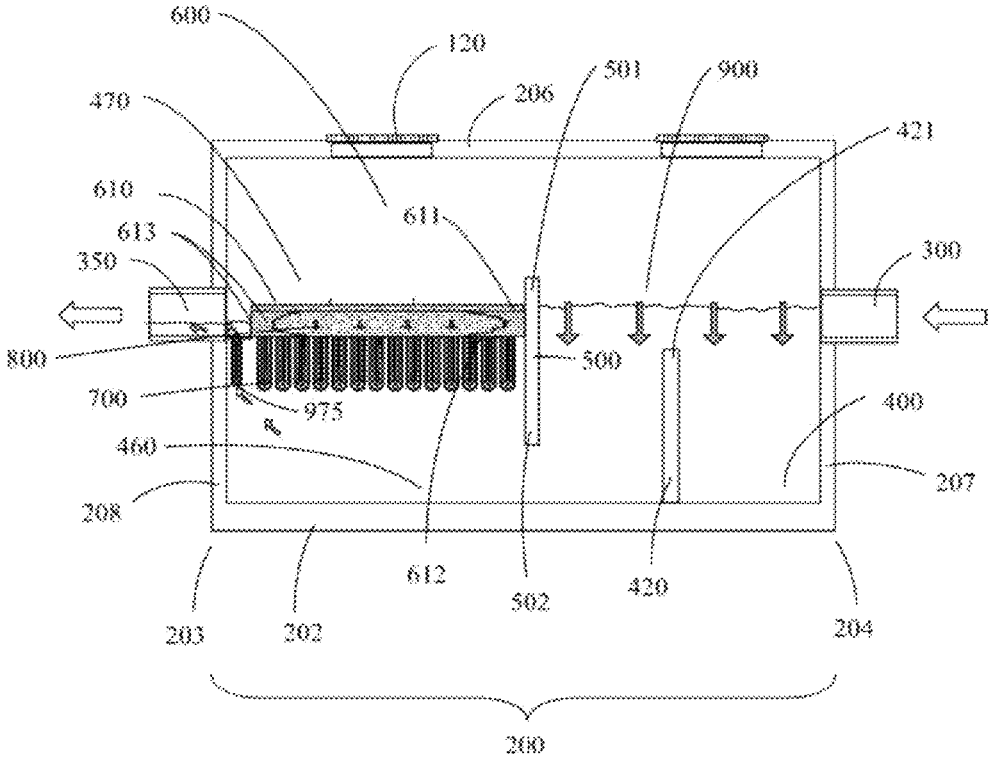
FIG. 7B. Cut-out, side view of an embodiment of the invention in after flow configuration.
Figure 7C:
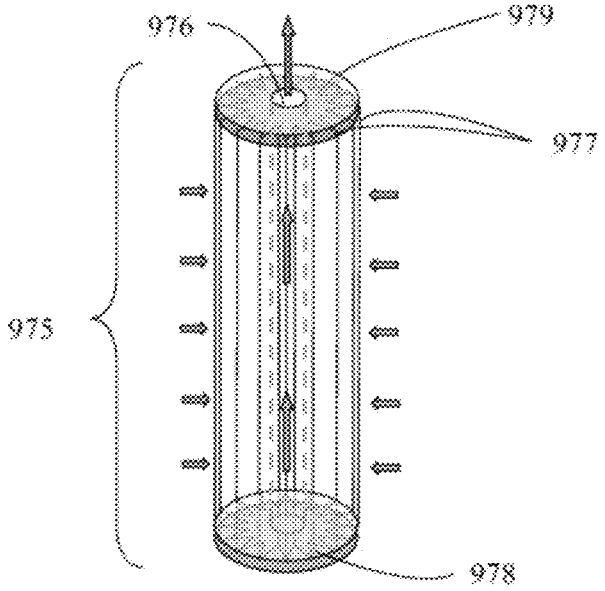
FIG. 7C. Side view of an embodiment of a filter drain cartridge of the invention.

FIG. 7A shows a cut-out, side view of an embodiment of a partitioned separator water treatment system with an upflow filter assembly that differs from the embodiment illustrated in FIG. 1 by having a filter drain cartridge 975, a smaller size version of the filter cartridge 700, mounted on bottom panel 612 between outflow opening 350 and the lateral side wall 613 that faces the outflow endwall 208 of the box 200 and by having bottom panel 612 positioned higher in box 200, even with the bottom of outflow opening 350. This configuration results in water draining from media filtration unit 610 when water is not entering inflow opening 300, as shown in FIG. 11B, by flowing through filter drain cartridge 975, and outflow opening 350. Filter drain cartridge 975 comprises a sheet of filter material, such as porous plastic, paper, or fiberglass, folded back and forth to form a series of pleats 977 formed into a closed cylinder, the ends of which are sealed closed by solid bottom end 978 and top end 979 that is solid other than orifice opening 976 (FIGS 7A, 7B, and 7C). The filter drain cartridge 975 is smaller than filter cartridges 700 and therefor has a lower filter rate capacity, which is a preferred configuration because it reduces the amount of water that does not flow through filtration media 800 prior to flowing through outflow opening 350 during periods of low or high flow. A filter drain cartridge 975 can, however, be of comparable or even greater size and or filtering capacity as compared to a filter cartridge 700. Once flow into box 300 recedes the water level in the media filtration unit 610 will drop as water continues to pass through filter drain cartridge 975 until the water level in chamber 600 is equal with the bottom of outflow opening 350. This allows the filtration media 800 to dry out between periods of operation.

Figure 8:
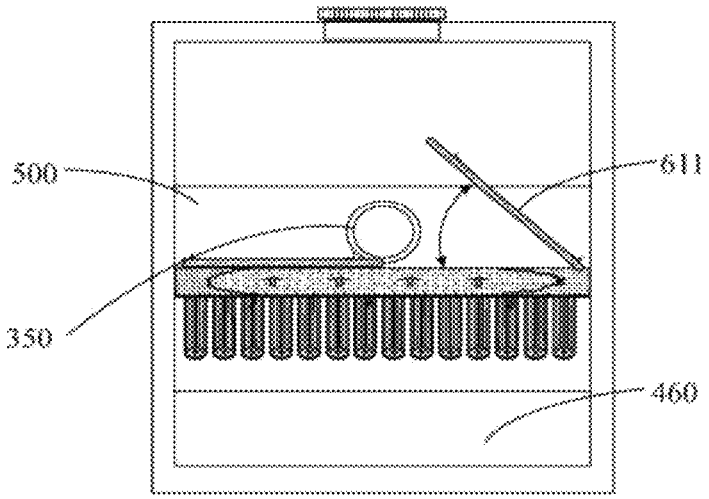
FIG. 8. Cut-out, outflow-end view of an embodiment of the invention.

FIG. 8 shows a cut-out, outflow-end view of an embodiment of a partitioned separator water treatment system with an upflow filter assembly in which a section of top panel 611 of media filtration unit 610 is configured as an openable hatch that provides access to the center of media filtration unit 610 for purposes of loading and removing filtration media 800 and filter cartridges 700.

Figure 9:
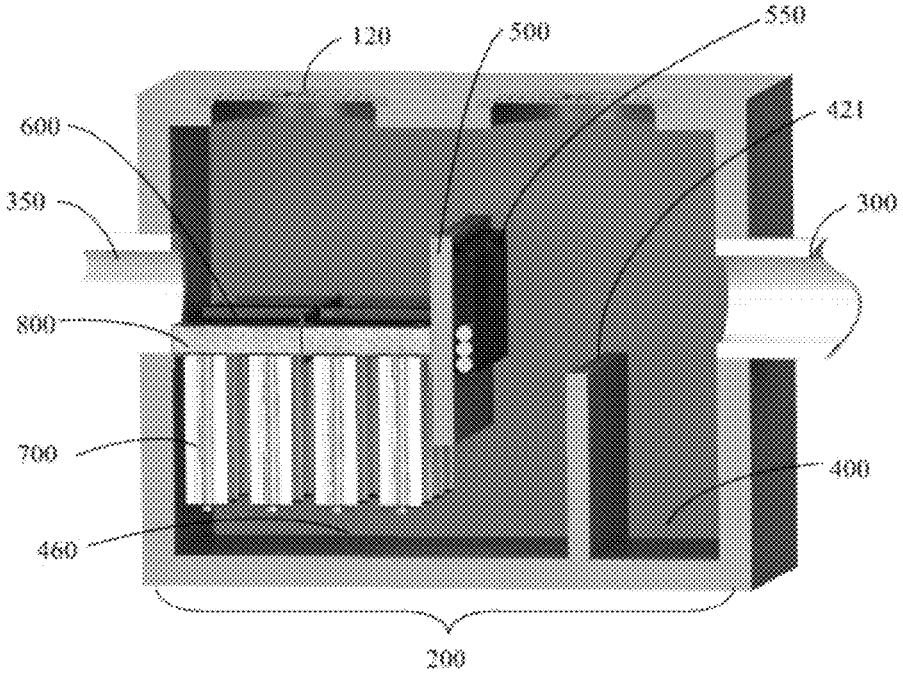
FIG. 9. Offset, elevation view of an embodiment of a partitioned separator water treatment system with an upflow filter assembly and a hydrocarbon filtration unit.

FIG. 9 shows an offset, elevation view of an embodiment of a partitioned separator water treatment system according to the invention with an upflow filter assembly and a hydrocarbon filtration unit.

FIG. 10 shows an offset, elevation view of an embodiment of an upflow filter assembly according to the invention.

Figure 11:
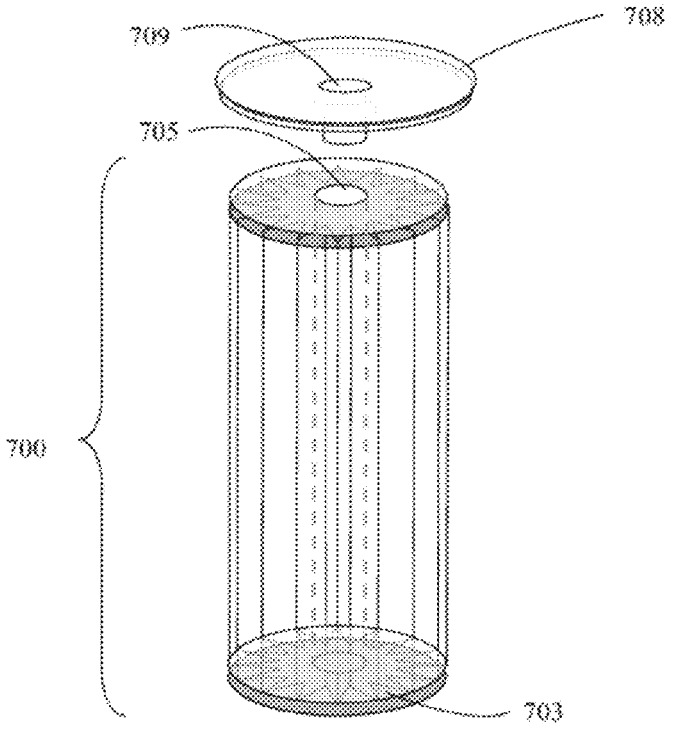
FIG. 11. Offset view of an embodiment of a filter cartridge-filtration medium assembly coupler.

FIG. 11 shows a coupler 708 that connects the filter cartridge 700 and its orifice openings 705 to inline orifices 614 contained within the bottom filtration panel 612 (also see FIG. 2B). Coupler 708 seats into the orifice 705 of the filter cartridge 700 and the inline orifices 614 to form a water tight seal. Water is passed from the filter cartridge to an area above the bottom panel 612 by the coupler opening 709.

In some embodiments, filter cartridges 700 comprise rigid housings made of strong, durable material such as metal, plastic, or fiberglass loaded with filtration material such as fiberglass, glass wool, and steel wool or filtration media and possessing screened or grated openings that permit water to pass through the filter cartridges and retain the filtration media within the filter cartridge housing. In some embodiments, filter cartridges are permanently attached to the bottom panel of a filtration media unit. In such embodiments, filter cartridges can be equipped with lids or hatches that provide access to the filtration media for removal or cleaning. In some embodiments, filter cartridges are reversibly mountable onto the bottom panel of a media filtration unit by, for instance, friction fittings, threaded fittings, bolts, screws, nails, clamps, and the like.

The content of U.S. Pat. No. 8,496,814 is hereby incorporated by reference in its entirety.

The apparatus and methods described are the preferred and alternate embodiments of this invention, but other methods are possible and are within the contemplation of this patent.

What is claimed is:

1. A partitioned separator water treatment system, comprising a box configured to accept water from a storm water drain, the box having a ceiling, a floor, two lateral walls, an inflow endwall, an inflow opening, an outflow endwall, and an outflow opening, the inflow endwall describing an inflow end of the box, and the outflow endwall describing an outflow end of the box, the inflow end of the box having at least one separation chamber weir dividing the box into a plurality of separation chambers, where at least one separation chamber weir is in sealing connection with the floor and two lateral walls of the box, but not the ceiling of the box, said at least one separation chamber weir having a top below a bottom level of the inflow opening, wherein said at least one separation chamber weir is situated such that water entering the inflow opening is capable of filling the plurality of separation chambers, and flowing said at least one separation chamber weir, trapping sediment and solid pollutants in the plurality of separation chambers, the outflow end of the box having a bypass weir in sealing connection with an upflow filter assembly comprising a media filtration unit, a plurality of filter cartridges and one or more filter drain cartridges, the bypass weir being in sealing connection with the lateral walls of the box, but not the floor or the ceiling of the box, the bypass weir having a top that is above the top of said at least one separation chamber weir, and the bypass weir having a bottom that is above the floor of the box, the media filtration unit being in sealing connection with the lateral walls of the box and having a top panel that is water permeable, a bottom panel positioned substantially even with a bottom level of the outflow opening, the bottom panel being configured to support each of the plurality of filter cartridges and the one or more filter drain cartridges, the media filtration unit further having side walls that are water impermeable, and filtration media between the top panel, the bottom panel, and the side walls, such that water is permitted to flow through the assembly to the outflow opening via the plurality of filter cartridges and at least one of the filtration media unit and the one or more filter drain cartridges, the one or more filter drain cartridges positioned between the outflow opening and the media filtration unit, a top of the one or more filter drain cartridges being aligned with the bottom level of the outflow opening such that during no flow periods, water in the media filtration unit flows back down from the filtration media to the outflow opening via the one or more filter drain cartridges, the filtration media capable of removing from water that flows therethrough, sediment, particulates, and dissolved pollutants, and each of the plurality of filter cartridges being operably coupled to the bottom panel of said media filtration unit and extending toward the floor of the box.

2. The partitioned separator water treatment system of claim 1, wherein the filtration media is a least one inorganic media selected from the group consisting of a zeolite, an expanded aggregate, a lava rock, an oxide-coated inert material, an alumina, an activated carbon, a perlite, a stonewool, a rockwool, and a pumice.

3. The partitioned separator water treatment system of claim 1, wherein at least one of the plurality of filter cartridges comprises a sheet of filter material selected from the group consisting of a plastic, a paper, a fiberglass, and a combination thereof folded back and forth into a series of pleats formed into a hollow cylinder, the ends of the cylinder sealed closed by a solid bottom end that is water impermeable and a solid top end that is water impermeable apart from an opening through which water can flow.

4. The partitioned separator water treatment system of claim 1, wherein at least one of the plurality of filter cartridges comprises a rigid housing made of metal, plastic, or fiberglass, the housing loaded with a filtration material selected from the group consisting of a fiberglass, a glass wool, and a steel wool and possessing a plurality of screened or grated openings configured to permit water to pass through the filter cartridges and retain the filtration material in the housing.

5. The partitioned separator water treatment system of claim 1, wherein the inflow opening is disposed on one or more of the lateral walls and the inflow endwall, between the inflow endwall and the bypass weir.

6. The partitioned separator water treatment system of claim 1, wherein the outflow opening is disposed on one or more of the lateral walls and the outflow endwall, between the ouflow endwall and the bypass weir.

7. The partitioned separator water treatment system of claim 1, wherein each of the plurality of filter cartridges are in sealed connection with a coupler that is in sealed connection with the bottom panel and forms a path for water to flow from an orifice of filter cartridge to an inline orifice of the bottom panel of the media filtration unit.

8. A partitioned separator water treatment system, comprising a box configured to accept water from a drain, the box having a ceiling, a floor, two lateral walls, an inflow endwall, an inflow opening, an outflow endwall, and an outflow opening, the inflow outflow end of the box, the inflow end of the box having at least one separation chamber weir having a top below a bottom level of the inflow opening, said at least one separation chamber weir dividing the box into a plurality of separation chambers, where at least one separation chamber weir is in sealing connection with the floor and two lateral walls of the box, but not the ceiling of the box, said at least one separation chamber weir is situated such that water entering the inflow opening is capable of filling the plurality of separation chambers and flowing over, said at least one separation chamber weir, trapping sediment and solid pollutants in the plurality of separation chambers, the outflow end of the box having a bypass weir in sealing connection with an assembly comprising a media filtration unit, a plurality of filter cartridges and one or more filter drain cartridges, the bypass weir being in sealing connection with the lateral walls of the box, but not the floor or the ceiling of the box, the bypass weir having a top that is above the top of said at least one separation chamber weir, and the bypass weir having a bottom that is above the floor of the box, the media filtration unit being in sealing connection with the lateral walls of the box and having a top panel that is water permeable, a bottom panel positioned substantially even with a bottom level of the outflow opening, the bottom panel being configured to support each of the plurality of filter cartridges and the one or more filter drain cartridges, the media filtration unit further having side walls that are water impermeable, and filtration media between the top panel, the bottom panel, and the side walls, such that water is permitted to flow through the assembly to the outflow opening via the plurality of filter cartridges and at least one of the filtration media unit and the one or more filter drain cartridges, the filter drain cartridges positioned between the outflow opening and the media filtration unit, a top of the filter drain cartridges being aligned with the bottom level of the outflow opening such that during no flow periods, water in the media filtration unit flows back down from the filtration media to the outflow opening via the one or more filter drain cartridges, the filtration media capable of removing from water that flows there through, sediment, particulates, and dissolved pollutants, the filter drain cartridge created by forming a pleated paper filter membrane around an orifice located at the center of each filter drain cartridge, and each of the plurality of filter cartridges being operably coupled to the bottom panel of the media filtration unit and extending toward the floor of the box.

9. The partitioned separator water treatment system of claim 8, wherein the filtration media is a least one inorganic media selected from the group consisting of a zeolite, an expanded aggregate, a lava rock, an oxide-coated inert material, an alumina, an activated carbon, a perlite, a stonewool, a rockwool, and a pumice.

10. The partitioned separator water treatment system of claim 8, wherein at least one of the plurality of filter cartridges comprises a sheet of filter material selected from the group consisting of a plastic, a paper, a fiberglass, and a combination thereof folded back and forth into a series of pleats formed into a hollow cylinder, the ends of the cylinder sealed closed by a solid bottom end that is water impermeable and a solid top end that is water impermeable apart from an opening through which water can flow.

11. The partitioned separator water treatment system of claim 8, wherein at least one of the plurality of filter cartridges comprises a rigid housing made of metal, plastic, or fiberglass, the housing loaded with a filtration material selected from the group consisting of a fiberglass, a glass wool, and a steel wool and possessing a plurality of screened or grated openings configured to permit water to pass through the filter cartridges and retain the filtration material in the housing.

12. The partitioned separator water treatment system of claim 8, wherein the outflow opening is on one or more of the lateral walls and the outflow endwall on an outflow side of the bypass weir.

13. The partitioned separator water treatment system of claim 8, wherein the inflow opening is disposed on one or more of the lateral walls and the inflow endwall, between the inflow endwall and the bypass weir.

14. The partitioned separator water treatment system of claim 8, where the filter cartridges are in sealed connection with a coupler that is in sealed connection with the bottom panel and forms a path for water to flow from an orifice of a filter cartridge to an inline orifice of the bottom panel of the media filtration unit.

* * * * *